US005315076A

United States Patent [19]

Renkes et al.

[11] Patent Number: 5,315,076

[45] Date of Patent: May 24, 1994

[54] PUSH BUTTON MULTIPLE CIRCUIT SWITCH ASSEMBLY WITH LAMINATED SLIDERS AND MEMBRANE

[75] Inventors: Kenneth R. Renkes; Lyle J. Bush, both of Morrison, Ill.

[73] Assignee: General Electric Company, Fort Wayne, Ind.

[21] Appl. No.: 959,704

[22] Filed: Oct. 13, 1992

[51] Int. Cl.[5] ..... H01H 9/20

[52] U.S. Cl. ..... 200/5 EB

[58] Field of Search ..... 200/5 A, 5 B, 5 E, 5 EA, 200/5 EB, 302.2

[56] References Cited

U.S. PATENT DOCUMENTS

| | | | |
|---|---|---|---|
| 3,600,529 | 8/1971 | Gartland, Jr. | 200/5 E |
| 3,652,811 | 3/1972 | Barney | 200/5 EB |
| 3,858,018 | 12/1974 | Walley | 200/5 EB X |
| 4,059,737 | 11/1977 | Gergaud | 200/5 A |
| 4,362,910 | 12/1982 | Boebel et al. | 200/5 EA |
| 4,362,912 | 12/1982 | Woodward | 200/5 B |
| 4,835,348 | 5/1989 | Poling et al. | 200/5 EA |

*Primary Examiner*—J. R. Scott
*Attorney, Agent, or Firm*—Ralph E. Krisher, Jr.

[57] ABSTRACT

A push button switch assembly has a housing, a switch mechanism mounted within the housing, a plurality of push rods extending through the housing and a plurality of elongate sliders movably mounted within the housing. The switch mechanism includes a plurality of paired electrical contacts. A first end of the push rods is formed to have an enlarged cross-section, and terminates within the housing. The push rods are axially movable relative to the housing between extended and depressed positions. The ends of the push rods interact with cam surfaces on the movable sliders to cause the sliders to move within the housing in response to movements of the push rods. Cam surfaces on opposing edges of the sliders interact with the switch mechanism to open and close selected ones of the switches. The axial displacement of the push rod required to actuate the switch is relatively short (approximately 1/16 inch). A flexible membrane may be disposed adjacent the push rod ends and the switch may be actuated by pressing on the surface of the flexible membrane. In one embodiment, two sliders are moved in opposing directions by one push rod to cooperatively interact with an electrical contact. In this embodiment, the lateral displacement of each slider (and the force required to cause the displacement) is reduced. In either embodiment, the cam surfaces on the sliders are designed to reduce or eliminate "teasing" of the electrical contacts.

36 Claims, 6 Drawing Sheets

PUSH BUTTON MULTIPLE CIRCUIT SWITCH ASSEMBLY WITH LAMINATED SLIDERS AND MEMBRANE

BACKGROUND AND SUMMARY OF THE INVENTION

This invention relates generally to electrical switches and, more particularly, to multiple push button switches having a short stroke and other improved features.

Multiple push button switches are well-known and are used in a wide variety of electrical equipment. Examples of such switches include those frequently used in household appliances, such as blenders, food processors, electric ranges, washing machines and air conditioners. A specific example of one such switch is shown in U.S. Pat. No. 4,362,912 to Woodward which is commonly assigned to the assignee of the present invention. Another switch of this general type (but which is disclosed in a single push button embodiment) is shown in U.S. Pat. No. 3,858,018 to Walley, which is also assigned to the assignee of the present invention. To the extent necessary for a full appreciation and understanding of the present invention, U.S. Pat. Nos. 3,858,018 and 4,362,912 are hereby incorporated by reference in their entireties into the present specification.

Switches such as those shown in the above-referenced patents are primarily mechanical devices in which one or more axially movable push rods interact with one or more laterally movable elongate sliders to open or close one or more electrical switch contacts. Such devices are reliable and relatively inexpensive, and are well-suited for applications such as those discussed above.

Alternative switch arrangements which may be suited for or adapted to these same applications include solid-state devices and membrane switches. The former may include touch-sensitive switches which may, for example, be activated by the capacitance associated with an operator who touches certain areas of a control panel or keypad. The latter may include switches in which two electrically conductive layers are separated by an insulator which is compressive to allow selected areas of the conductive layers to make contact with one another in response to pressure exerted by an operator. Both types of switches may be used in combination with additional devices (e.g., logic circuits) to effect the desired degree of control over a plurality of electrical circuits or elements. Both types of switches are relatively more complex than the mechanical switches described in the patents referenced above, and may be more expensive to manufacture, maintain or replace than the mechanical type switches discussed in those patents. However, both types of switches do have certain advantages over the mechanical type switches. For instance, both solid-state and membrane devices may be used in the design of a control panel which is essentially flat and which is not penetrated by one or more push rods required to actuate the switch. Such control panels are desirable for aesthetic reasons and for the ease with which they may be wiped or cleaned. Non-penetration of the control panel reduces the possibilities for contamination of interior components with dirt, moisture or other matter. Other features, such as lighted indicators, are relatively easily provided with switches of this type.

Among the several objects of the present invention is the provision of an improved electrical switch having advantageous or desirable features which are not present in the switches disclosed in the above-referenced patents. A more specific object of the invention is the provision of a push button switch which has a relatively short operating stroke, as compared to prior art switch assemblies, and which may be used with a flexible membrane such that a push rod of the switch may be axially displaced by a distance effective to open or close a pair of switching contacts by pressure exerted on a surface of the membrane. This structure allows the switch of the present invention to be used in combination with a flexible membrane and, thus, to offer advantages not previously associated with mechanical-type switches (i.e., switches which require that a push rod travel a relatively long axial distance and penetrate the surface of a control panel to effect a switching operation). Another object of the invention is to provide a push button switch having a relatively short stroke in which "teasing" of the contacts by unintended movements of the push rod or sliders is substantially reduced or restricted.

These and other objects of the present invention are achieved in an electrical switch assembly which comprises a housing, switch means mounted within the housing, a plurality of push rods extending through the housing and a plurality of generally elongate sliders movably mounted within the housing. The switch means preferably comprises a plurality of paired electrical contacts selectively movable to open and closed positions. The push rods have a first end, which is rolled or otherwise formed to have an enlarged cross-section, which terminates within the housing, and a second end which terminates exteriorly of the housing. The push rods are axially movable relative to the housing between at least a first (extended) position and a second (depressed) position. Each of the elongate sliders has a first edge and a first plurality of cam surfaces formed on the first edge for interacting with the paired electrical contacts of the switch means to selectively open and close the contacts as the slider moves within the housing. Each of the sliders further has a second edge and a second plurality of cam surfaces on the second edge for interacting with the first ends of respective ones of the push rods as the push rods are moved between the first and second positions. Each of the first ends of the push rods interacts with selected ones of the cam surfaces to cause respective ones of the sliders to move. Each of the cam surfaces on the second edges has a first portion having a first angle, relative to an axial centerline of a respective push rod, which is selected so as to require that a first predetermined level of force be applied to the push rod to cause the respective slider to begin to move away from the first position. Each of the cam surfaces also has a second portion having a second angle selected so as to require a second, substantially lower level of force be applied to the push rod to cause the respective slider to continue to move to the second position.

In one embodiment of the invention, the first portion of the second cam surface forms an angle of approximately 15° with a plane which extends through the first portion of the cam surface and perpendicularly to the axis of the push rod. The second portion of the second cam surface forms an angle with this plane which is substantially greater than 15°. In this embodiment, the first portion is a substantially flat surface. The second portion also comprises a substantially flat surface which extends from an edge of the first portion at an initial angle which is substantially greater than 15°. The second portion of the cam surface can, alternatively, be curvilinear in shape.

Each of the first plurality of cam surfaces comprises a first portion, a second portion and a transition portion connecting the first and second portions. The first portion of each cam surface is aligned, in non-engaging relation, with a respective one of the electrical contacts as the slider moves away from the first position in response to the interaction between the push rod and the first portion of the second cam surface. The transition portion engages the electrical contact when the first end of the push rod is in the vicinity of an intersection of the first and second portions of the second cam surface. The transition portion interacts with the electrical contact to move the contact to an open or closed position as the slider continues to move to the second position in response to the interaction between the push rod and the second portion of the second cam surface. A "notch" or depression is provided in the second portion of the first camming surface to receive a portion of the movable switch contact to reduce unintended movements (e.g., vibrations) of the slider and/or electrical contact.

In one embodiment of the invention, the axial displacement of the push rod required to cause a slider to move from the first position to the second position is approximately 1/16 inch. The lateral distance traveled by the slider in moving from the first position to the second position is approximately 0.130 inch. This embodiment may further comprise a flexible membrane having first and second surfaces and being disposed such that the second ends of the push rods lie immediately adjacent the second surface of the membrane such that the push rods can be actuated by a force applied to an opposing portion of the first surface of the membrane. The membrane may be at least partially translucent or transparent. A light or other visible indicator may be disposed adjacent the second surface of the membrane.

In an alternative embodiment of the invention, a single push rod interacts with a pair of generally elongate sliders movably mounted within the housing. Each of the sliders has a cam surface on a first edge for interacting with the paired electrical contacts of the switch means, and a cam surface on a second edge for interacting with the first end of the push rod. As the push rod is axially moved, the sliders move in opposite directions within the housing. The cam surfaces on the second edges of the pair of sliders cooperatively interact with the electrical contact so as to cause the switch means to open and close in response to the concurrent and opposing movements of the sliders. In this embodiment, the axial movement of each push rod is short enough to allow the use of a flexible membrane adjacent the push rods to provide a flat, smooth surface on a control panel. Due to the cooperative interaction between the sliders, the lateral distance traveled by each slider in response to the axial displacement of the push rod is substantially decreased. In one embodiment of the invention, this distance is approximately 0.095 inch.

Each of the embodiments of the switch of the present invention include features which are intended to reduce or eliminate "teasing" of the electrical contacts by unintended movements of the sliders and push rods. In the embodiment of the invention just described (wherein two sliders cooperatively interact to open or close an electrical contact), the cam surfaces on the first edges of the sliders form a "V" which interacts with the electrical contact to prevent unintended movements of the sliders when the electrical contact is in at least one of the open and closed positions. In the embodiment of the invention in which a single slider interacts with the electrical contacts, this "anti-teasing" function is performed by the first portion of the second cam surface and the "notch" formed in the second portion of the first cam surface.

Other objects, advantages and novel features of the present invention will become apparent from the following detailed description of the invention when considered in conjunction with the accompanying drawings.

DETAILED DESCRIPTION OF THE DRAWINGS

Figure 1:
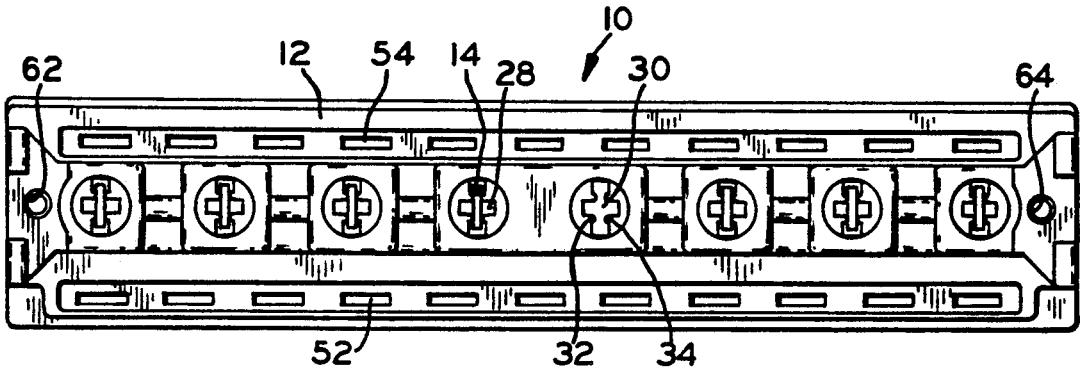
FIG. 1 shows a top view of a push button switch assembly of the type with which the present invention may be used.
Figure 2:
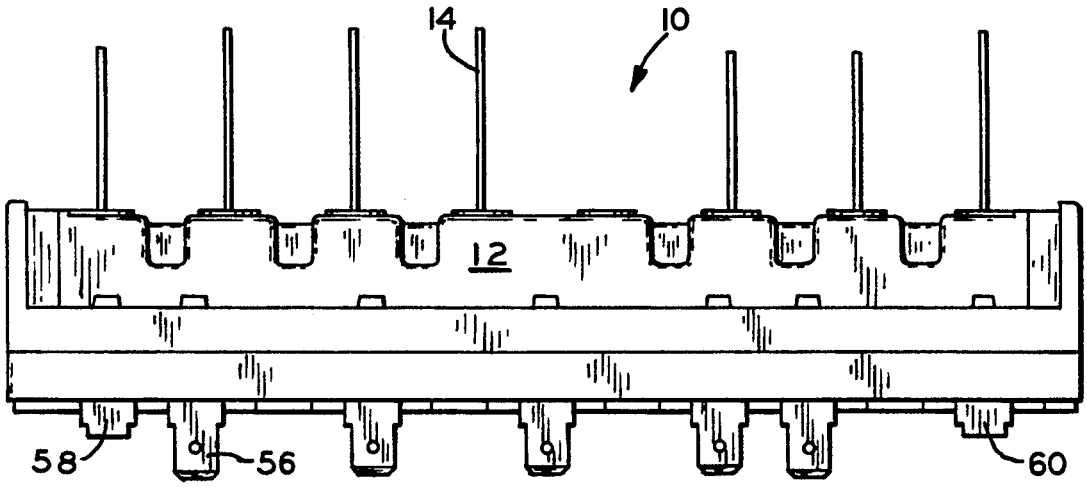
FIG. 2 shows a side view of the push button switch assembly of FIG. 1.

FIGS. 1 and 2 show top and side views, respectively, of an electrical switch assembly 10. Switch assembly 10 includes a housing 12 and a plurality of push rods, generally represented by push rod 14, which extend through a corresponding plurality of irregularly shaped openings generally represented by opening 28 in housing 12. The shape of each of the openings is best illustrated by reference to opening 30 which, in the embodiment of the switch illustrated, does not receive a push rod. Each of the subject openings is formed to include opposing projections (e.g., 32, 34) which are spaced apart so as to lie closely adjacent corresponding and opposing sides of a respective push rod so as to limit the range of lateral motion of the push rod at the point where the push rod passes through the housing.

Also shown in housing 12 are two rows of rectangular openings (illustratively represented by openings 52 and 54), selective ones of which receive terminals which secure the switch assembly together mechanically, and which provide connection points for electrical circuits controlled by switch assembly 10. Opposing rectangular openings receive terminal pairs which are not visible in FIG. 1, but which are generally represented by terminal 56 in FIG. 2. The terminal pairs provide termination points for a plurality of electrical switching contacts which are controlled (i.e., open and closed) by axial movements of one or more of the push rods 14. The terminals may be used to secure a bottom cover (not shown) to the switch housing. Accordingly, non-electrical or "dummy" terminals may be used (such as illustrated by dummy terminals 58 and 60), as needed. Portions of each of the terminals adjacent the short sides of the rectangular openings in the top of housing 12 are deformed outwardly to extend beyond the perimeter of the openings so as to mechanically secure each of the terminals to housing 12. A similar technique is used to secure the bottom cover in position.

Also shown in FIG. 1 are mounting holes 62 and 64. Holes 62 and 64 are blind holes formed in housing 12 which may (or may not) be threaded, and which are intended to receive mounting screws or other fasteners to secure switch assembly 10 in position on, for instance, the control panel of a household appliance.

Figure 3:
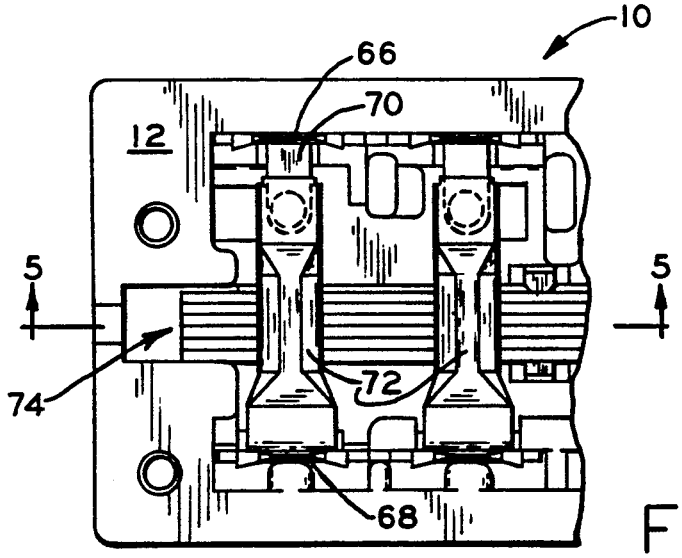
FIG. 3 shows a bottom view of the push button switch assembly of the same general type shown in FIGS. 1 and 2, with a bottom cover removed to reveal a representative portion of the internal structure.

FIG. 3 shows a representative portion of the interior of switch assembly 10 as viewed from the bottom of the switch assembly with the bottom cover removed. As illustrated in FIG. 3, each of an opposing pair of electrical terminals 66 and 68 (which are substantially similar or identical to terminal 56) are connected to a stationary electrical contact 70 and a movable contact 72, respectively. Contact 72, which is formed of a spring material and is biased by the spring-force of the material into electrical contact with contact 70, is moved away from and allowed to return to electrically conducting contact with stationary contact 70 by the action of one or more of a plurality of movable sliders, indicated generally by reference numeral 74. Sliders 74 move laterally within housing 12 in response to the reciprocating (axial) movements of push rods 14, as will be explained in additional detail below. As selected ones of sliders 74 move within housing 12, cam surfaces located on the outwardly facing edges (as viewed in FIG. 3) interact with the resilient switch contacts (e.g., contact 72) to open respective ones of the electrical circuits, or to allow the circuits to close. The manner in which a switch of this general type operates is discussed in additional detail in U.S. Pat. No. 4,362,912.

Figure 4:
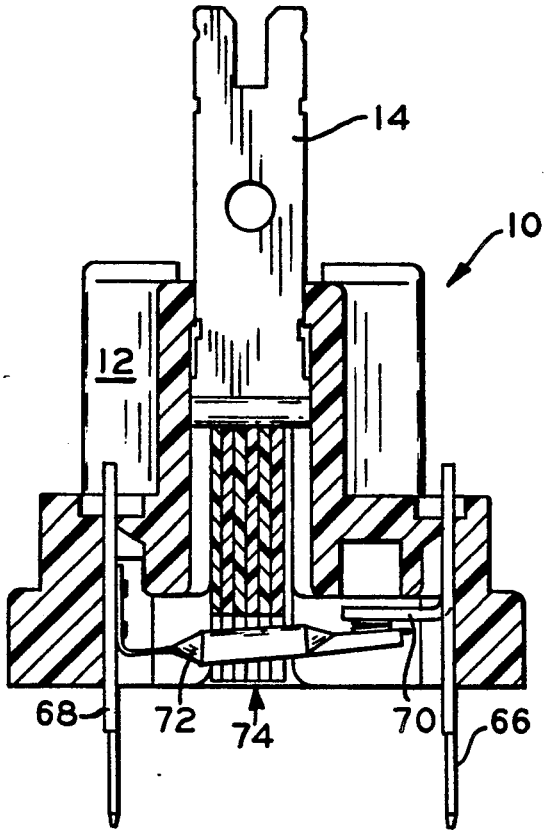
FIG. 4 shows a cross-sectional view taken along line 4—4 of FIG. 5.
Figure 5:
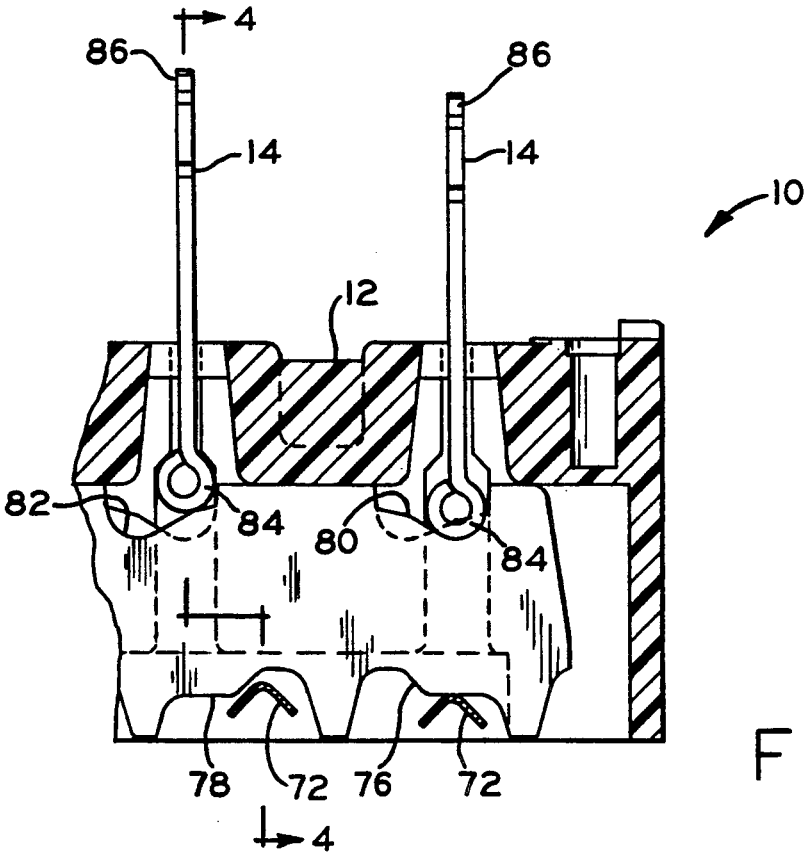
FIG. 5 shows a cross-sectional view taken along line 5—5 of FIG. 3.

FIG. 4 shows a cross-sectional view taken along line 4—4 in FIG. 5. FIG. 4 further illustrates the structure and relationship of each of the switch components discussed above.

FIG. 5 shows a longitudinal cross-section taken along line 5—5 in FIG. 3. Visible in FIG. 5 are a first plurality of cam surfaces 76 and 78 which are formed in a first edge of sliders 74. Each of the first cam surfaces interact with the movable contact (e.g., 72) of the contact pairs to selectively open and close the contacts as the slider moves laterally between first and second positions within the housing. Also visible in FIG. 5 are a second plurality of cam surfaces 80 and 82 which are formed in a second edge of the sliders 74. Cam surfaces 80 and 82 interact with the rolled ends 84 of respective push rods 14 as the push rods are axially moved by application of a force to a second end 86 of each rod which terminates exteriorly of the housing.

Figure 6:
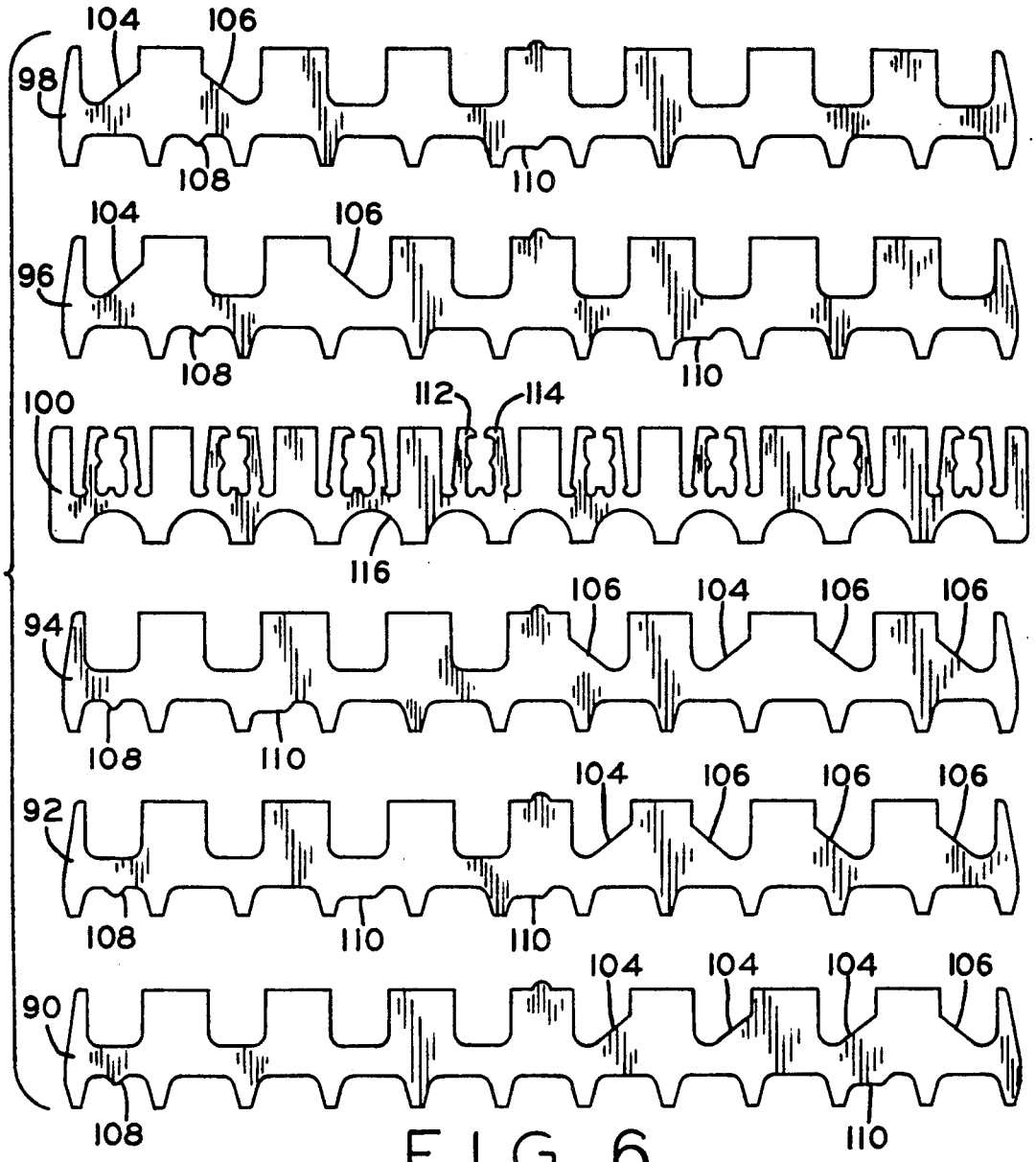
FIG. 6 shows a set of generally elongate sliders and a generally elongate detent element which have previously been used with a switch of the type illustrated in FIGS. 1 and 2.

FIG. 6 shows a set of generally elongate sliders 90–98 of FIG. 6 which have previously been used in a switch assembly of the type described above. Additional sets of sliders having cam surfaces of varying shapes are also shown in U.S. Pat. Nos. 3,858,018 and 4,362,912. FIG. 6 also shows detent element 100 illustratively disposed between sliders 94 and 96. Each of sliders 90–98 of FIG. 6 are provided with one or more cam surfaces 104 and 106 which interact with respective ends of the push rods to move respective ones of the sliders to the right (in the case of cam surface 104, as viewed in FIG. 6) or to the left (in the case of cam surface 106, as viewed in FIG. 6) when respective ones of the push rods are moved from an extended to a depressed position. It will be appreciated by those of ordinary skill in this art that movement of one slider in response to a push rod being moved from the extended to the depressed position may result in the movement of another push rod from the depressed to the extended position due to the interaction between the end of the second push rod and a second cam surface on the moving slider. Appropriate combinations of camming surfaces may be provided along the "top" edge (as viewed in FIG. 6) of sliders 90–98 of FIG. 6 to effect the appropriate interaction between the respective push rods, as needed.

Along the bottom edge (as viewed in FIG. 6) of sliders 90–98 of FIG. 6 are additional cam surfaces 108 and 110 which interact with respective ones of the movable switch contacts (e.g., contact 72 in FIG. 3) to open and close selected circuits. Again, additional camming surfaces and switch elements may be provided, as needed.

Detent element 100 is similar in overall length and width to sliders 90–98 of FIG. 6. However, the structure and function of detent element 100 differs markedly from the slider elements. Detent element 100 is non-movably mounted within switch housing 12, and is provided with a plurality of upwardly extending opposing resilient fingers, as generally represented by fingers 112 and 114. Camming surfaces are not provided along the bottom edge, as is the case with sliders 90–98 of FIG. 6. However, element 100 is provided with a plurality of semi-circular notches (e.g., 116) along its bottom edge to provide clearance for the movable switch contacts which extend across the switch assembly, as illustrated in FIGS. 3 and 4.

The slider sets shown in FIG. 6 and in U.S. Pat. No. 4,362,912 can be and have been used in commercially successful switches in, for example, the household appliance applications mentioned above. In these applications, the second ends of the push rods are typically fitted with a plastic push button, such as is shown in FIG. 1 of U.S. Pat. No. 4,362,912. The axial distance traveled by a push rod interacting with, for example, cam surfaces 104 or 106 of the slider set shown in FIG. 6, is approximately 0.125 inch. This length of travel is acceptable (and may be desirable) in applications where discreet push buttons protrude above the surface of a control panel. However, some applications for multi-contact switches call for the use of a flexible membrane above the individual switch actuating mechanisms so as to present a smooth surface along, for instance, the control panel of a household appliance. Such arrangements typically use solid state components or membrane switches to open and close electrical circuits in response to pressure exerted on the surface of the control panel by the appliance user.

Figure 7:
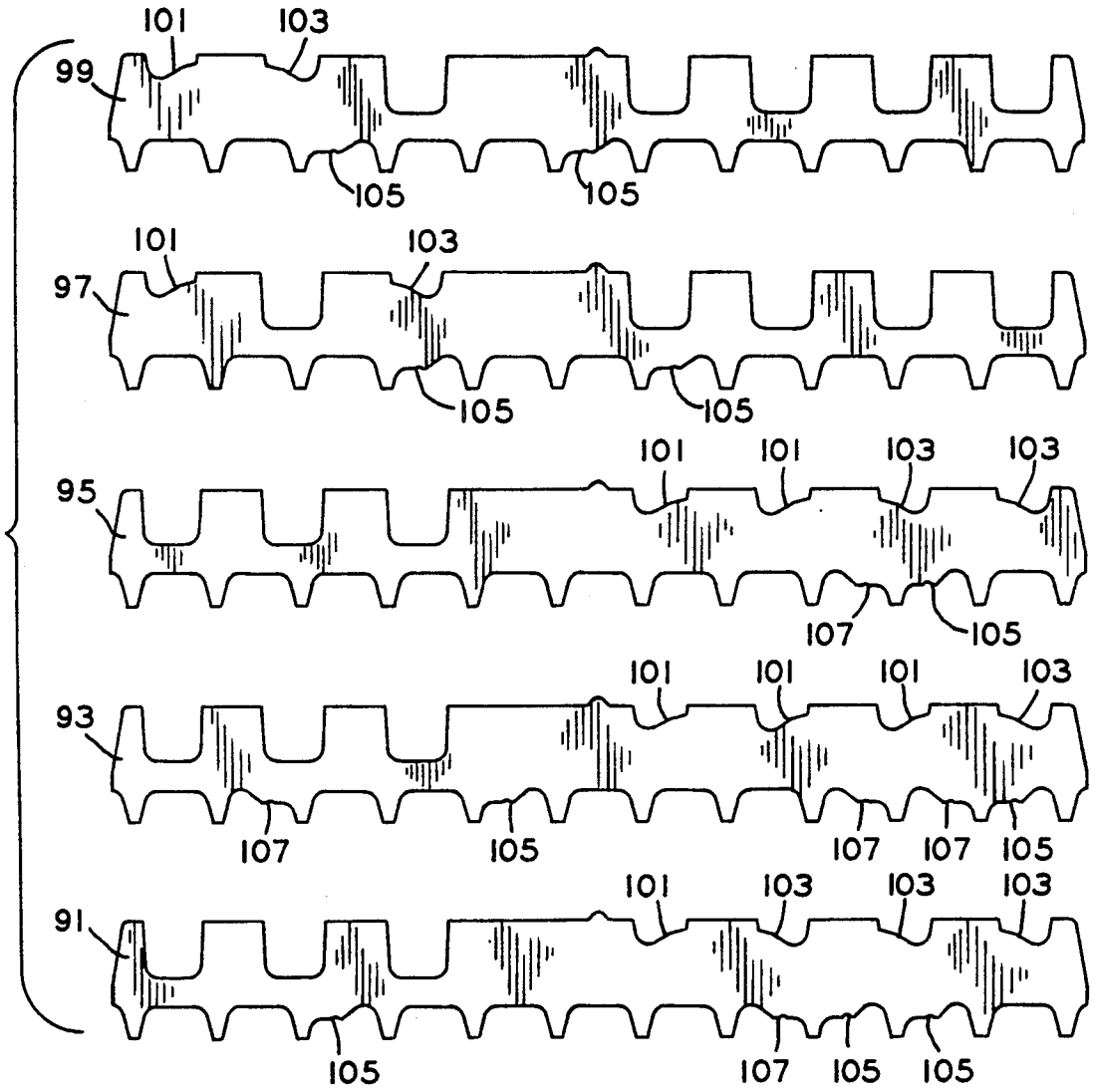
FIG. 7 shows a set of generally elongate sliders which may be used in a switch constructed in accordance with the present invention.

FIG. 7 shows a set of generally elongate sliders which may be used in a switch constructed in accordance with the present invention. Each of sliders 91–99 of FIG. 7 are provided with one or more cam surfaces 101 and 103 which interact with respective ends of the push rods to move respective ones of the sliders to the right (in the case of cam surface 101, as viewed in FIG. 7) or to the left (in the case of cam surface 103) when respective ones of the push rods are moved from an extended to a depressed position. As in the slider set of FIG. 6, appropriate combinations of camming surfaces may be provided along the "top" edge (as viewed in FIG. 7) of sliders 91–99 to effect the appropriate interaction between the respective push rods, as needed.

Along the bottom edge of sliders 91–99 of FIG. 7 are additional cam surfaces 105 and 107 which interact with respective ones of the movable switch contacts to open and close selected circuits, as will be described in additional detail below. Again, additional camming surfaces and switch elements may be provided, as needed or desired.

Figure 8:
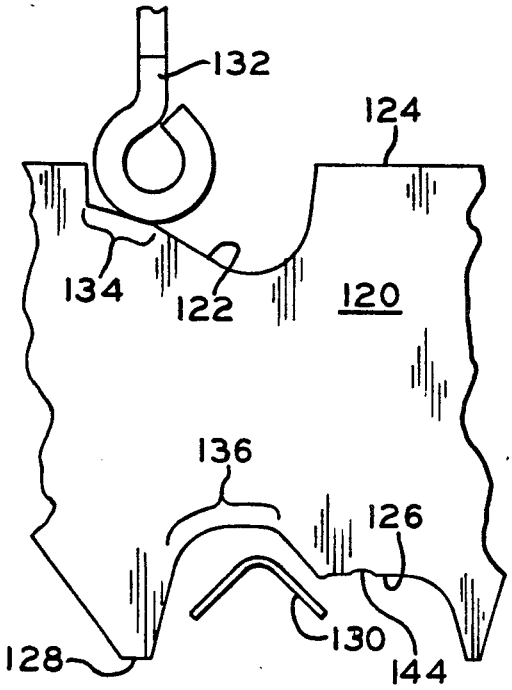
FIG. 8 shows a representative portion of a push rod, slider and movable contact arrangement constructed in accordance with the present invention in a first position.

FIG. 8 shows a representative portion of a slider 120 which is representative of sliders 91–99 of FIG. 7. Slider 120 is provided with a first cam surface 122 along a first or top edge 124, as illustrated. Cam surface 122 is substantially identical in orientation to cam surface 103 of FIG. 7. The interaction between cam surface 122 and the end of a push rod 132 is illustratively discussed below. These same principals of operation will apply to a cam surface which is oriented in accordance with cam surface 101 of sliders 91–99. A second cam surface 126 is formed in a second edge 128 so as to interact with movable switch contact 130 (which is comparable to switch contact 72 of FIG. 3). Cam surface 126 is substantially identical in orientation to cam surface 107 of FIG. 7 and, as is the case with cam surface 122, is discussed in detail below for illustrative purposes only. The same principals apply to the interactions which take place between cam surface 105 and the movable switching contacts of the switch assembly.

Cam surface 122 interacts with push rod 132 (which is comparable to push rod 14 of FIGS. 1–5) to cause slider 120 to move laterally within the switch housing. As is further illustrated in connection with FIGS. 9–11 below, the lateral movement of slider 120 in response to the interaction between cam surface 122 and push rod 132 causes cam surface 126 to interact with movable contact 130 to open or close an electrical circuit, as has previously been discussed.

The axial displacement of push rod 132 required to effect sufficient lateral movement of slider 120 is controlled, in large part, by the shape or angle of the interacting camming surface. The amount of force required to move the push rod and slider is similarly controlled, at least in part, by the angle of the camming surface at the point of contact with the push rod. The shape of camming surface 122 is specifically designed to allow for sufficient lateral movement of slider 120 in response to a relatively short (approximately 1/16 in.) axial movement of corresponding push rod 132. A switch of the subject type having such a relatively short push rod stroke can be used in combination with a flexible membrane to achieve the advantages which accompany a relatively flat, smooth and unpenetrated control surface, while rendering unnecessary the use of solid-state switching components.

Figure 9:
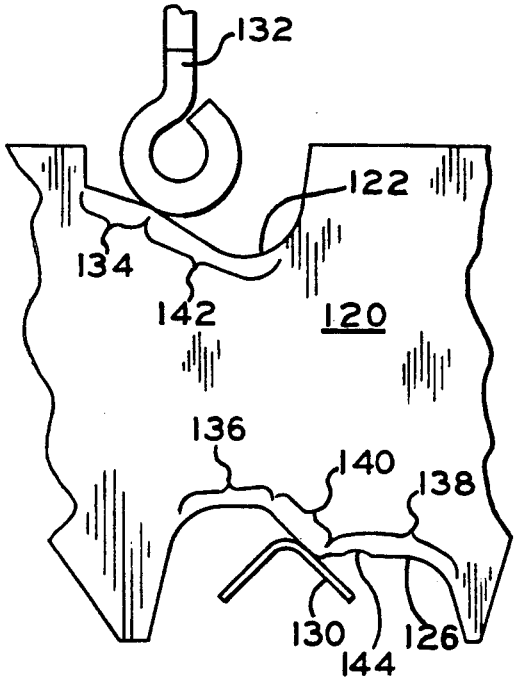
FIG. 9 shows the arrangement of FIG. 8 in which the push rod has been partially depressed to a second position.

Camming surface 122 has a first, relatively flat portion 134 which forms an angle of approximately 15° with the horizontal (i.e., a plane which extends through first portion 134 and perpendicularly to the longitudinal axis of push rod 132). This shape is intended to restrict or reduce unintended slider movements that would "tease" the electrical contacts open or closed in response to relatively minimal forces acting axially along the push rod. This geometry requires that an additional, and relatively higher, force be applied to push rod 132 to cause slider 120 to move. FIG. 9 illustrates the initial movement which occurs when such an added force is applied to push rod 132.

Figure 10:
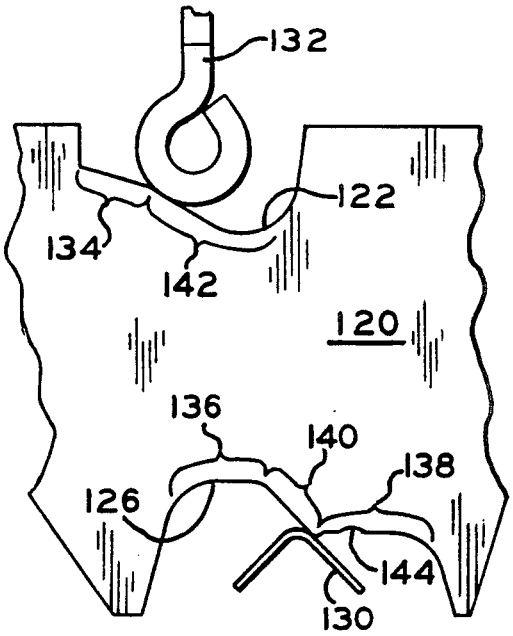
FIG. 10 shows the arrangement of FIGS. 8 and 9 in which the push rod has been further depressed to a third position.
Figure 11:
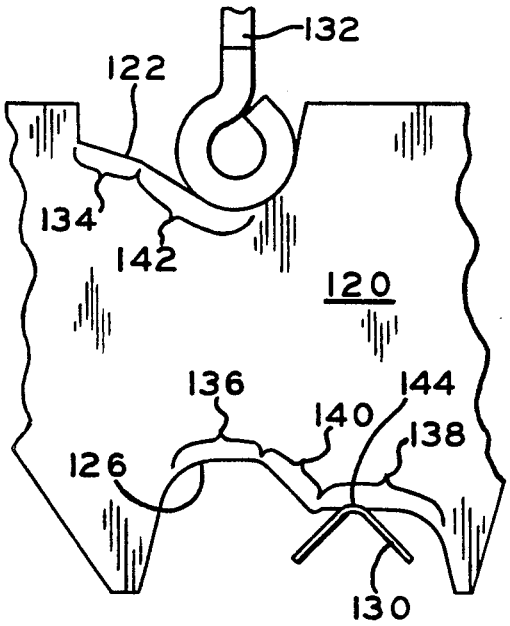
FIG. 11 shows the arrangement of FIGS. 8–10 in which the push rod has been fully depressed.

As illustrated in FIGS. 8–11, camming surface 126 is also provided with a first portion 136, which is aligned in non-engaging relation to contact 130 in the position depicted in FIG. 8. Surface 126 further has a second portion 138 which engages electrical contact 130 to hold the switch contacts in the open position as illustrated in FIG. 11. Connecting portions 136 and 138 is a transition portion 140. As shown in FIG. 9, transition portion 140 contacts electrical contact 130 as the point of contact between push rod 132 and first portion 134 of camming surface 122 nears or reaches an edge which defines an end of portion 134. Beyond the edge which defines the end of first portion 134 is a second portion 142 of camming surface 122. Second portion 142 comprises, in the embodiment shown, a flat surface which extends from the edge of portion 134 at an initial angle which is substantially greater than the angle of the first portion (i.e., substantially greater than approximately 15° as measured from the plane which extends through the first portion of the camming surface and perpendicularly to the axis of push rod 132). Although second portion 142 is illustrated in FIGS. 8–11 as a generally flat surface, other geometries (such as a surface portion which has a curvature) may be used if desired. As push rod 132 engages slider 120 along second portion 142 of camming surface 122, as illustrated in FIG. 10, the geometry of second portion 142 provides a mechanical advantage to the user to decrease the force required to move slider 120 and raise movable contact 130. Push rod 132 is shown in the fully depressed position in FIG. 11. In this position, movable contact 130 is supported by portion 138 of camming surface 126 and is held in non-engaging relation to the corresponding stationary electrical contact.

An additional feature of sliders 91–99 of FIG. 7 which is illustrated in the enlarged slider portion of FIGS. 8–11 is notch 144 which is formed as illustrated in portion 138 of cam surface 126. Notch 144 is a generally circular depression formed in portion 138 of surface 126 to receive the rounded portion of movable switch contact 130, as illustrated in FIG. 11. Notch 144 and spring contact 130 cooperate to restrict or reduce unintentional slider movement or vibration which might otherwise occur. Notch 144 also helps to restrict "teasing" of other contacts in a switch assembly by further requiring a build-up of force on a push rod so as to move the rounded bottom of contact 130 out of the notch. The depth of notch 144 is exaggerated in FIGS. 8–11 for purposes of illustration. In one embodiment of the invention, the actual depth of notch 144 ranges from 0.001–0.005 inch.

As noted, the particular geometry used to define camming surface 122 effects a sufficient lateral movement of slider 120, in response to a relatively short axial movement of push rod 132, to effect the desired movement of contact 130 to open or close the electrical circuit. Camming surface 122 is further intended to prevent "teasing" of the electrical contacts due to unintended movements or applications of force to push rod 132. First portion 134 of camming surface 122 requires that a first, relatively high level of force be applied to push rod 132 to cause slider 120 to begin to move away from its initial position. Second portion 142 of camming surface 122 is shaped so as to require a second, substantially lower level of force be applied to push rod 132 to cause slider 120 to continue to move to the second position. The axial movement of push rod 132 required to effect an opening or closing of the electrical circuit is approximately 1/16 inch. In one embodiment of the invention, the lateral movement of slider 120 in response to this axial displacement of push rod 132 is approximately 0.130 inch.

Figure 12:
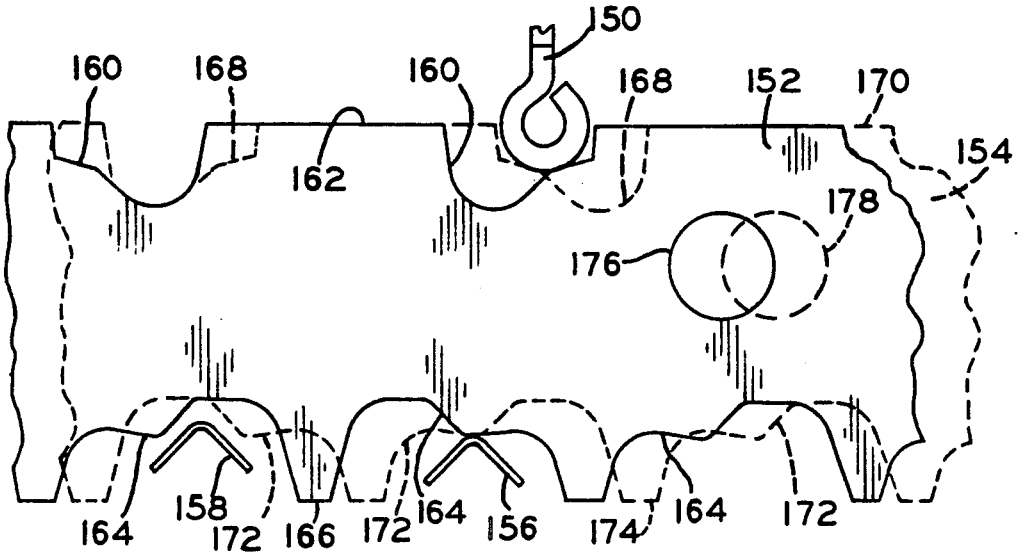
FIG. 12 shows an alternative arrangement of a push rod, sliders and electrical contacts constructed in accordance with another aspect of the present invention.
Figure 13:
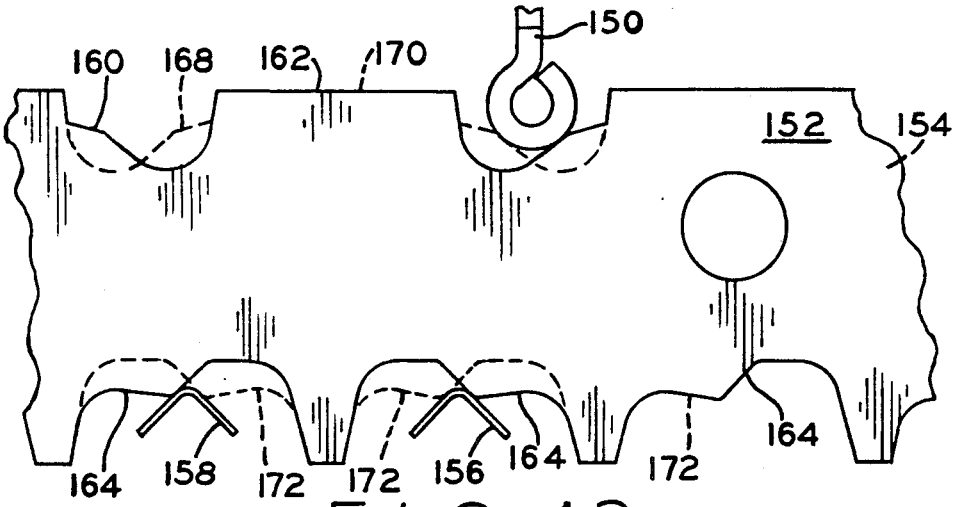
FIG. 13 shows the arrangement of FIG. 12 in which the push rod has been partially depressed.
Figure 14:
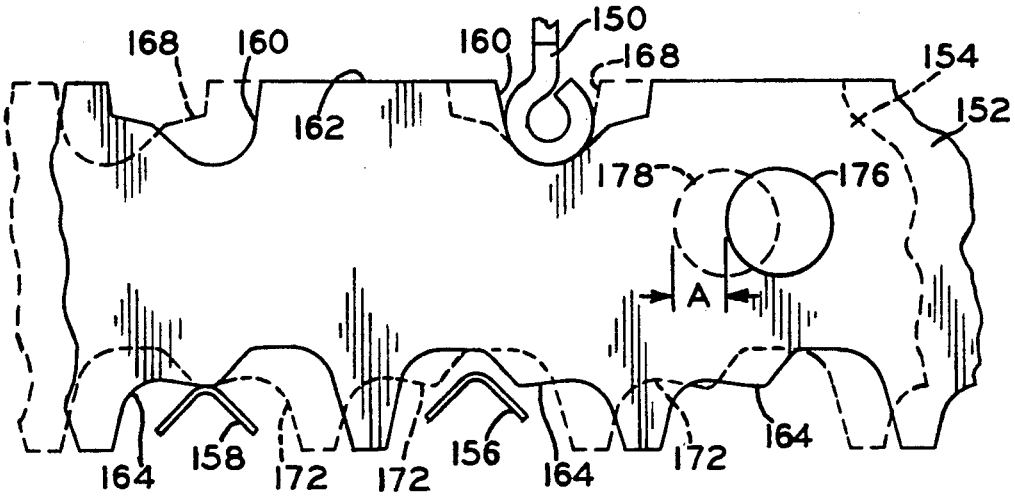
FIG. 14 shows the arrangement of FIGS. 12 and 13 in which the push rod has been fully depressed.

FIGS. 12–14 illustrate an alternative arrangement in which one or more electrical contact pairs may be opened and closed by a switch assembly which includes an axially movable push rod and laterally movable sliders. In the previously discussed designs (including the designs disclosed in U.S. Pat. Nos. 3,858,018 and 4,362,912) a single slider interacts with a given movable electrical contact to open or close the electrical circuit. As noted above, the lateral movement of each slider in the arrangement previously described is approximately 0.130 inch. The design illustrated in FIGS. 12–14 requires two sliders acting in concert in response to the axial movement of a single push rod to open or close an electrical contact pair. With specific reference to FIG. 12, there is shown a push rod 150, two sliders 152 and 154, and two movable electrical contacts 156 and 158. For purposes of clarity, slider 152 is shown in FIGS. 12–14 in solid lines and slider 154 is shown in dashed lines (all lines for both sliders are shown, for purposes of illustration, as if the slider in the foreground (slider 152) is transparent). Dashed lead lines are used to further distinguish the features of slider 154 from those of slider 152.

As is the case with the slider depicted in FIGS. 8–11, slider 152 is provided with at least one first cam surface 160 along a first edge 162, and at least one cam surface 164 along a second edge surface 166. Slider 154 is similarly provided with at least one cam surface 168 along first edge 170, and at least one cam surface 172 along edge 174. Cam surfaces such as those described above in connection with FIGS. 8–11 may be employed in connection with sliders 152 and 154. Alternatively, other cam surface shapes may be used.

Push rod 150 is shown in FIG. 12 in the fully extended position. As push rod 150 is depressed, slider 152 moves to the right, while slider 154 moves to the left. FIG. 13 shows the sliders at the approximate half-way point of lateral movement. This is illustrated by circles 176 and 178 which are associated with sliders 152 and 154, respectively. As illustrated, circles 176 and 178 are offset in FIG. 12, and are aligned in FIG. 13. FIG. 14 shows the sliders in their relative positions when push rod 150 is fully depressed. Circles 176 and 178 illustrate the relative positioning of the sliders when push rod 150 is in the fully depressed position. Each slider has moved to the right (slider 152) or to the left (slider 154) a distance which is generally represented by dimension A in FIG. 14.

With reference to FIG. 12, spring contact 156 is held in the raised or open position by cam surfaces 164 and 172. Spring contact 158 is in the lowered or closed position, and does not contact cam surfaces 164 or 172. When push rod 150 is depressed to the midway point, as shown in FIG. 13, both spring contacts 156 and 158 are in contact with the respective cam surfaces on the adjacent sliders and each spring contact is positioned approximately midway between the open and closed positions. When push rod 150 is fully depressed, as shown in FIG. 14, spring contact 156 is in the lower or closed position, while spring contact 158 is held in the raised or open position by cam surfaces 164 and 172.

An advantage to the arrangement shown in FIGS. 12–14 relates to the reduction of lateral movement required of each slider, in response to the axial movement of a push rod, to effect an opening or closing of a contact pair. In a switch of the general type illustrated in FIGS. 1 and 2, which uses a slider set of the type illustrated in FIG. 6, the lateral movement of the slider is approximately 0.170 inch. In a switch which utilizes sliders having cam surfaces such as those illustrated in FIGS. 8–11 (i.e., in which the axial displacement of the push rod is greatly reduced), lateral slider movement is approximately 0.130 inch. In a switch which utilizes the arrangement illustrated in FIGS. 12–14, each slider moves laterally approximately 0.095 inch to effect an opening and/or closing of one or more switch contacts. The reduction of slider lateral movement translates into a mechanical advantage at the push rod, requiring less force to actuate the switch. Due in part to this reduction, use of the same geometry illustrated in FIGS. 8–11 for the cam surfaces which contact push rod 150 is desirable to restrict contact "teasing" as previously described. The geometry of the cam surfaces which interact with the spring contact is designed such that when the spring contact is in the raised position (e.g., contact 156 in FIG. 12), a "V" is formed by cam surfaces 164 and 172 of the sliders at the point of contact with the spring contact. With reference to FIG. 12, spring contact 156 rests in this "V" to further restrict or reduce unintentional slider movement which might otherwise be caused by, for instance, vibration. This feature also helps to restrict contact "teasing" by requiring a build-up of force on push rod 150 to move the spring contact out of the "V."

Figure 15:
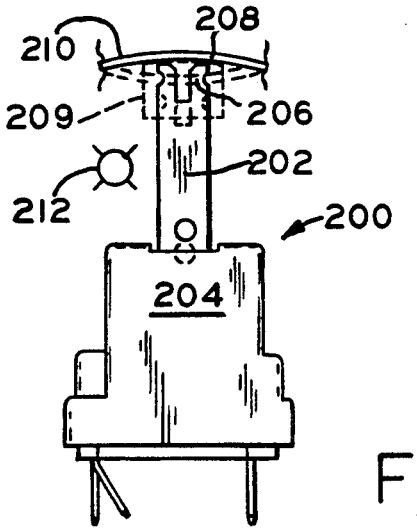
FIG. 15 shows an end view of the switch of the present invention as used with a flexible membrane element.

FIG. 15 shows an end view of a switch assembly 200 which is fitted with sliders of the type shown in FIGS. 8–11 or FIGS. 12–14. One or more push rods 202 extend through openings in housing 204 of switch assembly 200 in the same way as previously described above. Disposed immediately adjacent an end 206 of push rod 202 is a flexible membrane 208 such that push rod 202 may be axially displaced by the distance necessary to open or close the electrical contacts in switching assembly 200 by a force applied to the top surface (i.e., surface 210) of membrane 208. A plastic cap 209 (illustratively shown in dashed lines), or similar covering, may be provided on end 206 of push rod 202, if desired. As previously discussed, use of such a continuous membrane as a part of the control panel of an appliance may be desirable in certain applications. Previously, such "smooth" control panels required switch assemblies which utilize solid state or membrane switch components and technology. The present invention allows the use of a flexible membrane, such as that illustrated in FIG. 15, in combination with a switch assembly which utilizes reliable and relatively inexpensive mechanical components.

Flexible membrane 208 may be opaque or, if desired, fully or partially translucent or transparent. If appropriate or desired, an indicator, generally represented in FIG. 15 by light element 212, may be used with a translucent or transparent membrane.

From the preceding description of the preferred embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

We claim:

1. An electrical switch assembly comprising:

a housing;

switch means mounted within said housing, said switch means having a plurality of paired electrical contacts selectively movable to open and closed positions;

a plurality of push rods extending through said housing, each push rod having a first end which terminates within the housing, and a second end which terminates exteriorly of the housing, said push rods being axially movable relative to the housing; and a plurality of generally elongate sliders movably mounted within the housing, each of said sliders having a first edge and a first plurality of cam surfaces on said first edge for interacting with the paired electrical contacts of the switch means to selectively open and close the contacts as the slider moves between first and second positions within the housing, and each of said sliders having a second edge and a second plurality of cam surfaces on said second edge for interacting with the first ends of respective ones of the push rods as said push rods are axially moved, each of said first ends of the push rods interacting with at least one of the cam surfaces on said second edges of the sliders to cause a respective one of the sliders to move;

wherein each of said cam surfaces on said second edges has a first portion having a first angle, relative to an axial centerline of a respective push rod, selected so as to require that a first predetermined level of force be applied to the push rod to cause the respective slider to begin to move away from said first position, and a second portion having a second angle selected so as to require a second, substantially lower level of force be applied to the push rod to cause the respective slider to continue to move to said second position.

2. An electrical switch assembly according to claim 1, wherein said first portion of said second cam surface forms an angle of approximately 15° with a plane which extends through said first portion of the cam surface and perpendicularly to the axis of the push rod.

3. An electrical switch assembly according to claim 2, wherein said second portion of said second cam surface forms an angle substantially greater than 15° with said plane which extends through the first portion of the cam surface and perpendicularly to the axis of the push rod.

4. An electrical switch assembly according to claim 1, wherein said first portion of said second cam surface comprises a substantially flat surface which forms an angle of approximately 15° with a plane which extends through said surface and perpendicularly to the axis of the push rod.

5. An electrical switch assembly according to claim 4, wherein said second portion of said second cam surface comprises a substantially flat surface which extends from an edge of said first portion at an initial angle which is substantially greater than 15° as measured from the plane which extends through the flat surface of the first portion.

6. An electrical switch assembly according to claim 4, wherein said second cam surface comprises a curvilinear surface which extends from an edge of said first portion and which forms an angle substantially greater than 15° with the plane which extends through the first portion of the cam surface and perpendicularly to the axis of the push rod.

7. An electrical switch assembly according to claim 1, wherein each of said first plurality of cam surfaces comprises a first portion, a second portion and a transition portion connecting said first and second portions, and wherein said first portion is aligned, in non-engaging relation, with a respective one of said electrical contacts as the slider moves away from said first position in response to the interaction between the push rod and the first portion of the second cam surface, and wherein said transition portion engages the electrical contact when the first end of the push rod is in the vicinity of an intersection of the first and second portions of the second cam surface, and wherein the transition portion interacts with the electrical contact to move the contact to an open or closed position as the slider continues to move to said second position in response to the interaction between the push rod and the second portion of the second cam surface.

8. An electrical switch assembly according to claim 7, wherein the second portion of each of the first cam surfaces is provided with a notch to receive a portion of the electrical contact when the slider is in the second position.

9. An electrical switch assembly according to claim 1, wherein the axial displacement of the push rod required to cause the slider to move from the first position to the second position is approximately 1/16".

10. An electrical switch assembly according to claim 9, wherein the distance traveled by the slider in moving from the first position to the second position is approximately 0.130".

11. An electrical switch assembly according to claim 1, further comprising a flexible membrane having first and second surfaces and being disposed such that the second ends of the push rods lie immediately adjacent the second surfaces of the membrane such that the push rods can be actuated by a force applied to an opposing portion of the first surface of the membrane.

12. An electrical switch assembly according to claim 11, wherein said membrane is at least partially translucent or transparent, and further comprising indicator means disposed adjacent the second side of the membrane.

13. An electrical switch assembly comprising:

a housing;

switch means mounted within said housing, said switch means having at least one pair of electrical contacts selectively movable to open and closed positions;

at least one push rod extending through said housing and having a first end which terminates within the housing, and a second end which terminates exteriorly of the housing, said push rod being axially movable relative to the housing; and at least one generally elongate slider movably mounted within the housing, said slider having a first edge and a first cam surface on said first edge for interacting with at least one of the paired electrical contacts of the switch means to selectively open and close the contacts as the slider moves between first and second positions within the housing, said slider having a second edge and a second cam surface on said second edge for interacting with the first end of the push rod as said push rod is axially moved so as to cause the slider to move within the housing;

wherein said cam surface on said second edge of the slider has a first portion having a first angle, relative to an axial centerline of a push rod, selected so as to require that a first predetermined level of force be applied to the push rod to cause the slider to begin to move away from said first position, and a second portion having a second angle selected so as to require a second, substantially lower level of force be applied to the push rod to cause the slider to continue to move to said second position.

14. An electrical switch assembly according to claim 13, wherein said first portion of said second cam surface forms an angle of approximately 15° with a plane which extends through said first portion of the cam surface and perpendicularly to the axis of the push rod.

15. An electrical switch assembly according to claim 14, wherein said second portion of said second cam surface forms an angle substantially greater than 15° with said plane which extends through the first portion of the cam surface and perpendicularly to the axis of the push rod.

16. An electrical switch assembly according to claim 13, wherein said first portion of said second cam surface comprises a substantially flat surface which forms an angle of approximately 15° with a plane which extends through said surface and perpendicularly to the axis of the push rod.

17. An electrical switch assembly according to claim 16, wherein said second portion of said second cam surface comprises a substantially flat surface which extends from an edge of said first portion at an initial angle which is substantially greater than 15° as measured from the plane which extends through the first portion of the cam surface and perpendicularly to the axis of the push rod.

18. An electrical switch assembly according to claim 16, wherein said second cam surface comprises a curvilinear surface which extends from an edge of said first portion and which forms an angle substantially greater than 15° with the plane which extends through the first portion of the cam surface and perpendicularly to the axis of the push rod.

19. An electrical switch assembly according to claim 13, wherein said cam surface on the first edge of the slider comprises a first portion, a second portion and a transition portion connecting said first and second portions, and wherein said first portion is aligned, in non-engaging rotating with a respective one of said electrical contacts as the slider moves away from said first position in response to the interaction between the push rod and the first portion of the second cam surface, and wherein said transition portion engages the electrical contact when the first end of the push rod is in the vicinity of an intersection of the first and second portions of the second cam surface, and wherein the transition portion interacts with the electrical contact to move the contact to an open or closed position as the slider continues to move to said second position in response to the interaction between the push rod and the second portion of the second cam surface.

20. An electrical switch assembly according to claim 19, wherein the second portion of each of the first cam surfaces is provided with a notch to receive a portion of the electrical contact when the slider is in the second position.

21. An electrical switch assembly according to claim 13, wherein the axial displacement of the push rod required to cause the slider to move from the first position to the second position is approximately 1/16".

22. An electrical switch assembly according to claim 21, wherein the distance traveled by the slider in moving from the first position to the second position is approximately 0.130".

23. An electrical switch assembly according to claim 13, further comprising a flexible membrane having first and second sides and being disposed such that the second ends of the push rods lie immediately adjacent the second side of the membrane such that the push rods can be actuated by a force applied to an opposing portion of the first side of the membrane.

24. An electrical switch assembly according to claim 23, wherein said membrane is at least partially translucent, and further comprising indicator means disposed adjacent the second side of the membrane.

25. An electrical switch assembly comprising:

a housing;

switch means mounted within said housing, said switch means having at least one electrical contact selectively movable to open and closed positions;

at least one push rod extending through said housing, and having a first end which terminates within the housing, and a second end which terminates exteriorly of the housing, said push rod being axially movable relative to the housing; and a pair of generally elongate sliders movably mounted within the housing, each of said sliders having a first edge and a cam surface on said first edge for interacting with the paired electrical contacts of the switch means to selectively open and close the contacts as the sliders move between first and second positions within the housing, and each of said sliders having a second edge and a cam surface on said second edge for interacting with the first end of the push rod as the push rod is axially moved, so as to cause the sliders to move in opposite directions within the housing;

wherein said cam surfaces on the second edges of the pair of sliders cooperatively interact with the electrical contact so as to cause the switch means to open and close in response to the concurrent and opposing movements of the sliders.

26. An electrical switch assembly according to claim 25, further comprising a flexible membrane having first and second surfaces and being disposed such that the second ends of the push rods lie immediately adjacent the second surface of the membrane such that the push rods can be actuated by a force applied to an opposing portion of the first surface of the membrane.

27. An electrical switch assembly according to claim 26, wherein said membrane is at least partially translucent or transparent, and further comprising indicator means disposed adjacent the second side of the membrane.

28. An electrical switch assembly according to claim 25, wherein the distance traveled by each slider in response to the axial displacement of the push rod is approximately 0.095 inch.

29. An electrical switch assembly according to claim 25, wherein the cam surfaces on the first edges of the sliders form a V which interacts with the electrical contact to prevent unintended movements of the sliders when the electrical contact is in at least one of said open and closed positions.

30. An electrical switch assembly comprising:

a housing;

switch means mounted within said housing, said switch means having at least one electrical contact selectively movable to releasably secured open and closed positions;

at least one push rod extending through said housing, and having a first end which terminates within the housing, and a second end which terminates exteriorly of the housing, said push rod being axially movable relative to the housing;

means camingly engaging the electrical contact for moving the electrical contact to at least one of said releasably secured open and closed positions in response to axial movements of said push rod; and a flexible membrane having first and second surfaces and being disposed such that the second ends of the push rods lie immediately adjacent the second surface of the membrane such that the push rods can be actuated by a force applied to an opposing portion of the first surface of the membrane.

31. An electrical switch assembly according to claim 30, wherein said membrane is at least partially translucent or transparent, and further comprising indicator means disposed adjacent the second side of the membrane.

32. An electrical switch assembly according to claim 30, wherein the axial displacement of the push rod required to open or close the contact is approximately 1/16 inch.

33. An electrical switch assembly according to claim 30, wherein said means for moving the electrical contact comprises at least one generally elongate slider movably mounted within the housing, said slider having a first edge and a first cam surface on said first edge for interacting with at least one of the paired electrical contacts of the switch means to selectively open and close the contacts as the slider moves between first and second positions within the housing, said slider having a second edge and a second cam surface on said second edge for interacting with the first end of the push rod as said push rod is axially moved so as to cause the slider to move within the housing.

34. An electrical switch assembly according to claim 33, wherein said cam surface on said second edge of the slider has a first portion having a first angle, relative to an axial centerline of a push rod, selected so as to require that a first predetermined level of force be applied to the push rod to cause the slider to begin to move away from said first position, and a second portion having a second angle selected so as to require a second, substantially lower level of force be applied to the push rod to cause the slider to continue to move to said second position.

35. An electrical switch assembly comprising:

a housing;

switch means mounted within said housing, said switch means having at least one electrical contact selectively movable to open and closed positions;

at least one push rod extending through said housing, and having a first end which terminates within the housing, and a second end which terminates exteriorly of the housing, said push rod being axially movable relative to the housing;

means for moving the electrical contact to at least one of said open and closed positions in response to axial movements of said push rod; and a flexible membrane having first and second surfaces and being disposed such that the second ends of the push rods lie immediately adjacent the second surface of the membrane such that the push rods can be actuated by a force applied to an opposing portion of the first surface of the membrane;

wherein said means for moving the electrical contact comprises at least one generally elongate slider movably mounted within the housing, said slider having a first edge and a first cam surface on said first edge for interacting with at least one of the paired electrical contacts of the switch means to selectively open and close the contacts as the slider moves between first and second positions within the housing, said slider having a second edge and a second cam surface on said second edge for interacting with the first end of the push rod as said push rod is axially moved so as to cause the slider to move within the housing.

36. An electrical switch assembly comprising:

a housing;

switch means mounted within said housing, said switch means having at least one electrical contact selectively movable to open and closed positions;

at least one push rod extending through said housing, and having a first end which terminates within the housing, and a second end which terminates exteriorly of the housing, said push rod being axially movable relative to the housing;

means for moving the electrical contact to at least one of said open and closed positions in response to axial movements of said push rod; and a flexible membrane having first and second surfaces and being disposed such that the second ends of the push rods lie immediately adjacent the second surface of the membrane such that the push rods can be actuated by a force applied to an opposing portion of the first surface of the membrane;

wherein said means for moving the electrical contact comprises at least one generally elongate slider movably mounted within the housing, said slider having a first edge and a first cam surface on said first edge for interacting with at least one of the paired electrical contacts of the switch means to selectively open and close the contacts as the slider moves between first and second positions within the housing, said slider having a second edge and a second cam surface on said second edge for interacting with the first end of the push rod as said push rod is axially moved so as to cause the slider to move within the housing; and wherein said cam surface on said second edge of the slider has a first portion having a first angle, relative to an axial centerline of a push rod, selected so as to require that a first predetermined level of force be applied to the push rod to cause the slider to begin to move away from said first position, and a second portion having a second angle selected so as to require a second, substantially lower level of force be applied to the push rod to cause the slider to continue to move to said second position.

* * * * *